United States Patent [19]

Riehlmann

[11] 3,946,833

[45] Mar. 30, 1976

[54] COLLAPSIBLE LADDER SUITABLE FOR USE AS FIRE ESCAPE

[76] Inventor: Joseph F. Riehlmann, 5862 Fleur de Lis Drive, New Orleans, La. 70100

[22] Filed: Dec. 13, 1973

[21] Appl. No.: 427,012

[52] U.S. Cl. ..... 182/20; 182/96; 182/195

[51] Int. Cl.[2] ..... E06C 9/12

[58] Field of Search ..... 182/19, 20, 21, 95, 96, 182/195

[56] References Cited

UNITED STATES PATENTS

| | | | |
|---|---|---|---|
| 278,865 | 6/1883 | Brainard | 182/195 |
| 905,529 | 12/1908 | Hengstler | 182/21 |
| 1,047,618 | 12/1912 | Dawson | 182/95 |
| 1,084,737 | 1/1914 | Hajek | 182/95 |
| 1,567,447 | 12/1925 | McCracken | 182/195 X |
| 2,529,112 | 11/1950 | Steele | 182/21 |
| 3,444,958 | 5/1969 | McCall | 182/195 X |

*Primary Examiner*—Robert L. Wolfe
*Assistant Examiner*—David H. Corbin
*Attorney, Agent, or Firm*—Plumley and Tyner

[57] ABSTRACT

A collapsible ladder suitable for installation on high-rise buildings and capable of modification to be architecturally unobstrusive and compatible with a variety of architectural designs is described. The ladder comprises two or more telescoping stile pair sections in which the upper stile section has an attached upper rung and the lower stile section has an attached lower rung. The intermediate rungs are slidably mounted in the telescoping stile members which are made of channel stock. In the normal position covering a window the telescoping stile pairs are retracted and the rungs are stacked one over the other adjacent to the attached upper rung. In an emergency the ladder can be released to the extended position for use from inside a window whereby it falls on pivot arms down and away from the building at a distance sufficient to permit passage of a person between the building and the ladder, the lower stile section extends, and the rungs fall into spaced position held by spacer arms between them. Release of one ladder actuates a release mechanism on the similarly mounted ladder on the floor below and so on, allowing an escape passage to a safe level or, if necessary, to the ground.

1 Claim, 7 Drawing Figures

COLLAPSIBLE LADDER SUITABLE FOR USE AS FIRE ESCAPE

BACKGROUND OF THE INVENTION

This invention relates to collapsible ladders particularly suitable for use in series as an emergency escape mechanism for high-rise buildings.

Modern high-rise buildings are typically designed with no provision for emergency escape, such as during a fire, except for the elevators and internal stairways. Elevators are likely to be inoperative in a serious fire and are, in any event, not recommended as an escape route. Similarly, internal stairways often become blocked during a fire. As a consequence, a serious tragedy has occurred where internal escape routes are unavailable.

Accordingly, there is a need for alternative external escape means. Preferably, such escape means would be of a design versatile enough for installation on a large percentage of existing and future high-rise constructions which vary considerably in their designs. It is also desirable that such escape means not detract from the esthetic design of the building but that it be capable of modification to blend with any of a variety of architectural styles.

It is, therefore, an object of this invention to provide a collapsible ladder suitable for installation on high-rise structures for emergency escape.

It is a further object of this invention to provide a fire escape for high-rise buildings which is both highly functional and esthetically pleasing in design.

Another object of this invention is the provision of a collapsible ladder mounted in a window frame which could be supplied as a single unit for easy incorporation into a building.

Still another object of this invention is the provision of a fire-escape ladder capable of modification to blend with a variety of high-rise designs.

SUMMARY OF THE INVENTION

In accordance with this invention, a collapsible ladder having an esthetically pleasing basic design that lends itself to modification for use with a variety of architectural styles as a fire-escape comprises a plurality of telescoping stile sections made from channel material in which the upper stile section has a permanently mounted upper rung and the lower stile section has a permanently mounted lower rung, the intermediate rungs being slidably mounted in the channeled stiles and pivoted spacer arms, "no-kink chain", or the like hold the slidable rungs in the desired normal spaced relation. In the storage position the ladder is mounted flush against the building over a window or within a window frame, the telescoping stile sections retracted to their minimum length, the upper mounted rung and the slidably mounted rungs stacked as a deck of cards. The ladder mechanism is held in the storage position on pivot arms which, upon actuation of a release mechanism, allow the ladder to fall in a downward and outward arc away from the building far enough to permit passage of a person between the ladder and the building. At the same time the lower telescoping section falls by gravity to the extended ladder position and the slidable rungs fall from their stacked position into normal ladder spacing held by the spacer arms. The release mechanism can be actuated from within the window or in response to a central alarm, or both.

Each floor of the high-rise building is provided with one of the afore-described ladder sections, each ladder section having a release mechanism actuated by the release of the ladder immediately above it. Thus, the release of the ladder section on an upper story causes the release of the ladder section immediately below it in turn releasing the next section below, one after the other, until all sections are released in a "domino" effect allowing passage to the ground level. The ladder can be installed in existing buildings with appropriate attachment by means of the pivot arms mentioned above. The ladder can also be supplied as a structural unit attached within a window frame or use in new construction.

In itself, the ladder of this invention has a rather pleasing appearance which would not detract from the appearance of a building on which it was installed since in the storage position all that is visible are the stile members and the bottom rung which can be designed to blend with the design of the window frame and the horizontal slats of stacked rungs which can be designed to cover only a small portion of the upper section of the window. Moreover, design possibilities are enhanced by the possibility of covering the ladder assembly in whole or in part with suitable materials, such as structural aluminum, fiberglas or plastic panels. For instance, in a building utilizing tinted or mirrored glass in the windows, the covering over the ladder unit can be tinted or mirrored plastic either transparent or opaque, as desired. In such a case, the windows containing the ladder unit would be virtually indistinguishable from the other windows from the outside of the building. Aside from the esthetic advantages, the use of such a covering would also serve to obstruct the escapee's outward view and thus provide a safety feature by reducing the escapee's consciousness of height.

DETAILED DESCRIPTION OF PREFERRED EMBODIMENT

Figure 1:
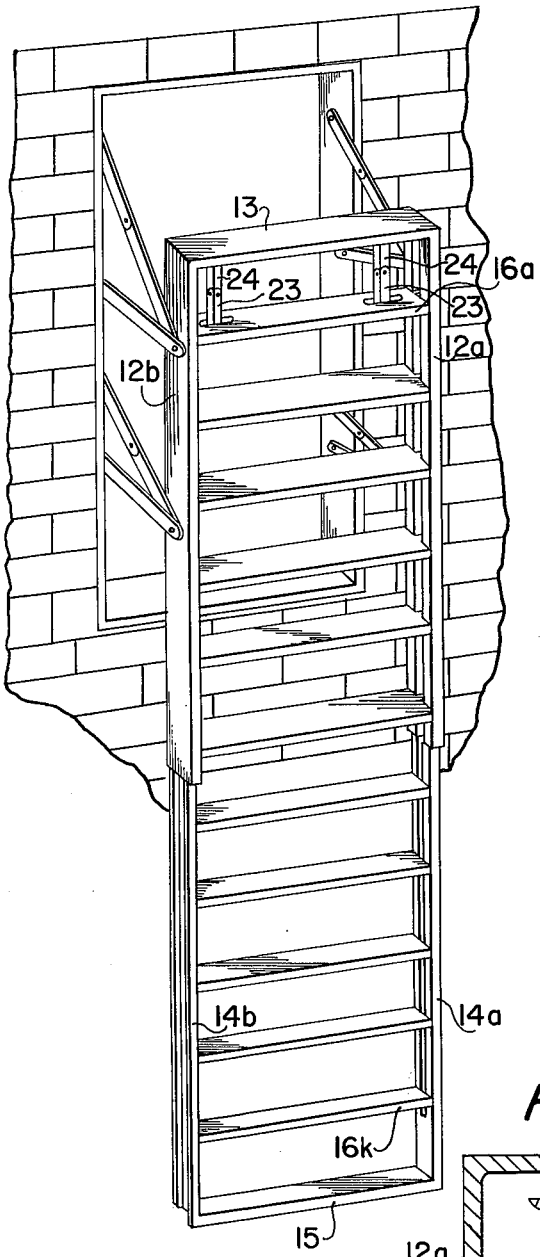
FIG. 1 is a perspective view of the ladder of this invention, in the extended position, installed as a window unit in a building, details shown in other drawings are omitted.
Figure 2:
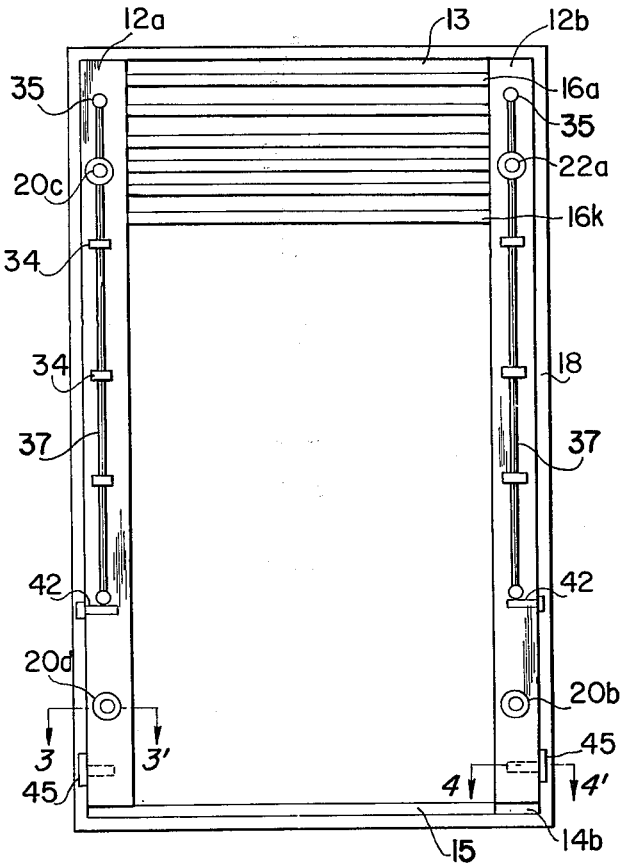
FIG. 2 is a front elevation of the ladder in the collapsed storage position.
Figure 3:
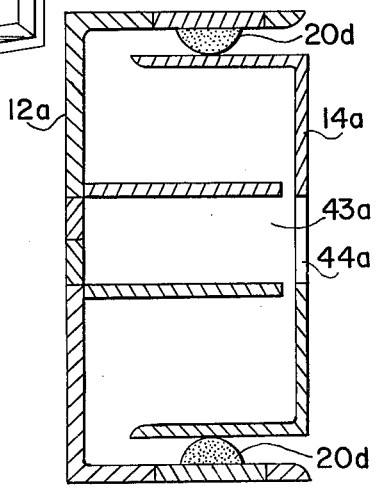
FIG. 3 is a section taken along line 3–3′ in FIG. 2.
Figure 4:
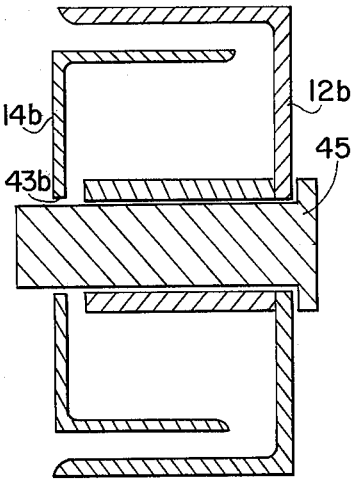
FIG. 4 is a section taken along line 4–4′ in FIG. 2.

The essential features of this invention are illustrated in FIGS. 1 and 2 which show a ladder of this invention mounted as a unit in a frame member of a window suitable for use as a fire-escape. It is to be understood, however, that this invention is not limited to fire-escapes nor to ladders which are supplied as an integral unit with a window frame member but can be used advantageously in other applications in which foldable ladders are suitable.

Figure 7:
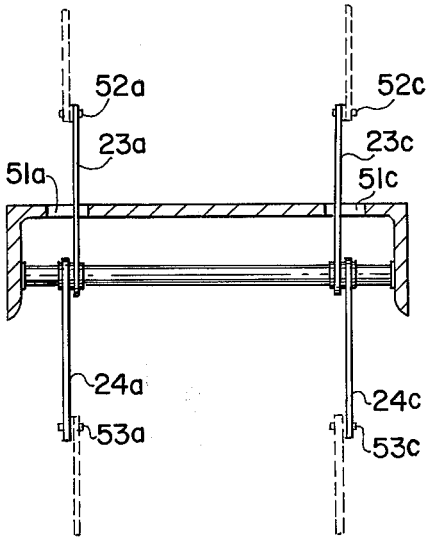
FIG. 7 is a section of the rung taken along line 7–7′ of FIG. 6.
Figure 6:
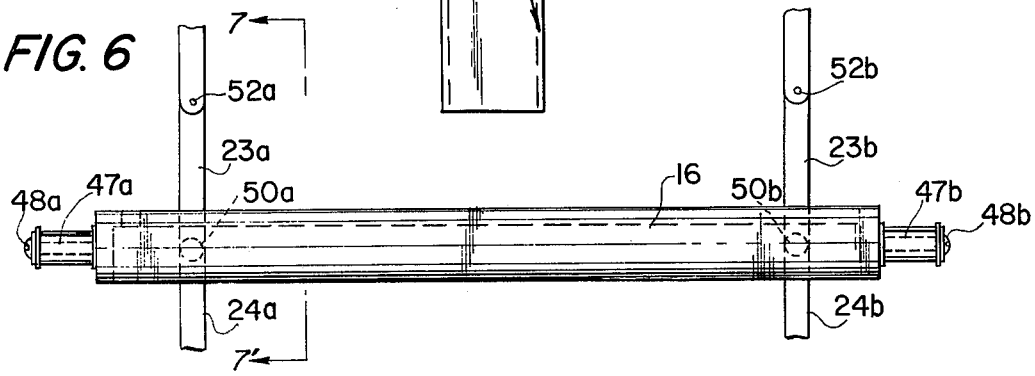
FIG. 6 is a front elevation of a slidable rung including the spacer arms in the extended position.

Referring to FIG. 1 the ladder comprises upper stile members 12*a,b* made of channel stock having a rung 13 attached near their upper extremities. Lower stile members 14*a* and 14*b* telescope within the upper stile members 12*a* and 12*b* and have a rung 15 attached to their lower extremities. Intermediate rungs 16*a–k* are slidably mounted in the upper stile members 12*a,b* and lower stile members 14*a,b*. Each of these slidable rungs is held in appropriate spaced relationship by a pair of upper spacer arms 23 and lower spacer arms 24, all of which are not shown. The operation of the spacer arms will be described in more detail in the discussion of FIGS. 6 and 7 below.

Figure 5:
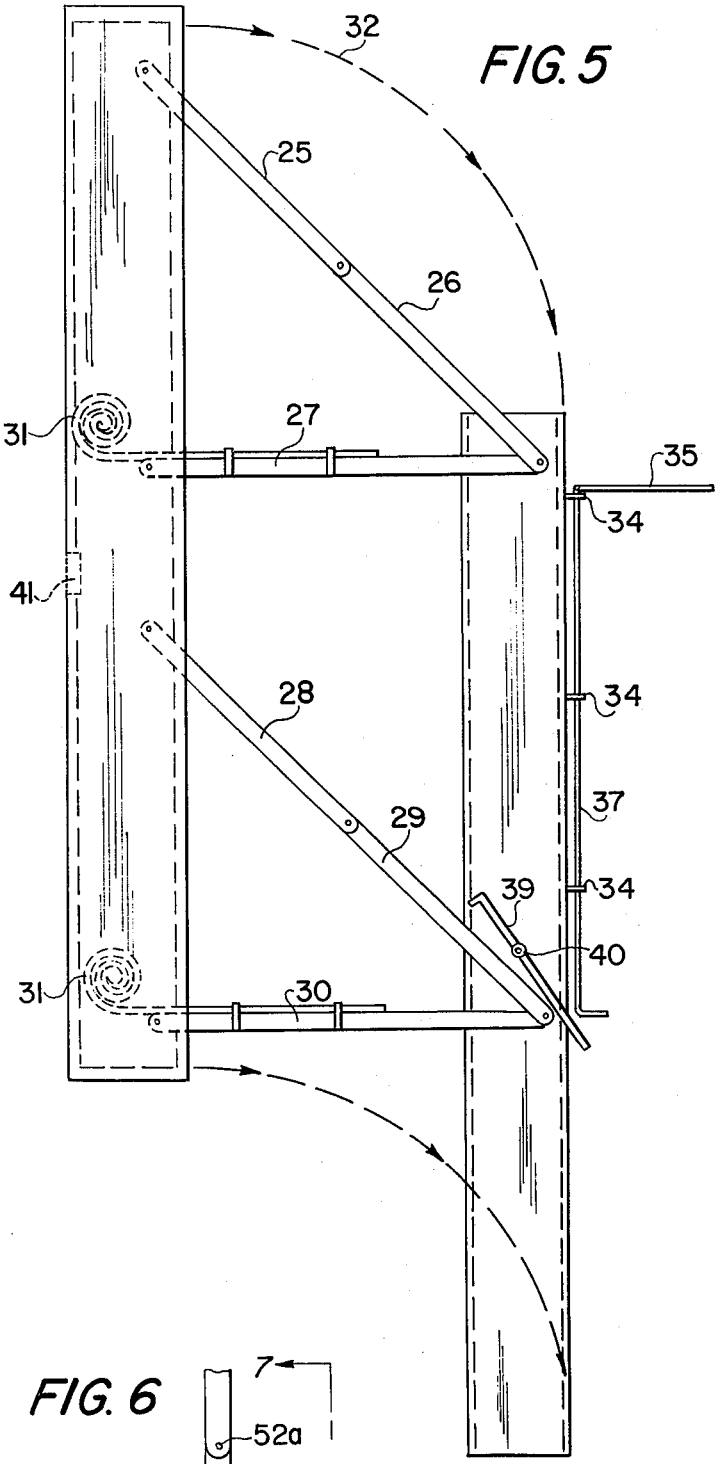
FIG. 5 is a side elevation of the ladder of this invention, extended away from the frame member but with the lower ladder in the unextended position.

When not in use the ladder appears in the storage position shown in FIG. 2 in which the slidable rungs 16*a–k* are stacked one atop each other as a deck of cards immediately below the upper attached rung 13. The entire ladder assembly is attached to the window frame 18 or otherwise attached to the building by pivot arms 25, 26, 27, 28, 29 and 30, as shown in FIG. 5. As shown in FIG. 5 in the storage position the ladder is within a window frame (shown in dotted lines within the frame member 18) or otherwise substantially flush with the building. In the event of an emergency the ladder can be released from its storage position whereby it falls outwardly and downwardly from the building in the arc 32 held in position by the pivot arms 25–30. The length of the pivot arms are selected so that the distance between the building and the ladder in its use position is sufficient to permit passage of a person between the building and the ladder. As the upper section of the ladder defined by upper stile members 12*a,b* and attached rung, 13 falls away from the building the lower section of the ladder defined by lower stile members 14*a* and *b* and attached rung 15, is free to fall by gravity. Also free to fall are the slidable intermediate rungs 16*a–k* forming the extended ladder shown in FIG. 1 reaching to the floor below.

The ladder can be locked into the storage position by the device shown in FIG. 5 comprising locker lever 39 mounted on pivot 40 which engages locking bar 41 when the ladder is in the storage position. The locking lever is preferably provided with an extension operative from inside the window so that the ladder can be released from inside the window. Also provided is an outside release mechanism which is attached to each of the upper stile members 12*a* and *b* comprising release bar 35 perpendicularly attached to rod 37 which is slidably mounted in rod guides 34. The lower end of rod 37 is bent outwardly to engage flange 42 which extends from locking lever 39. The release mechanism is constructed so that when a series of ladders are mounted in windows one above each other the release of one of the upper ladders will cause its upper stile members to contact the release bars 35 on the next lower ladder causing release of the next lower ladder which in turn contacts the release bar on the ladder beneath it causing its release, seriatim, until all of the ladders are released.

To facilitate movement of the ladder pivot arms 27 and 30 can be provided with springs 31 mounted in guides 33 so that springs exert additional force urging the ladder to the extended position once the release mechanism has been actuated.

Free movement between the telescoping upper stile members 12*a* and *b* and lower stile members 14*a* and *b* is assisted by the provision of slides 20*a–d* which can be made of hemispheres of Teflon. Stile members 12*a* and *b* are provided with slots 43*a* and 43*b* respectively. Stile members 14*a* and 14*b* are provided with slots 44*a* and *b* respectively. Rung guides 47*a* and *b* are accomodated within the slots 43 and 44 permitting free movement of the rungs along the slots. The slot in lower stile members 14*a* and 14*b* extends along only part of the length of the lower stile members. To prevent the lower stile members from falling out completely, the upper stile members are provided with studs 45 which permit the lower stile members 14*a* and *b* to telescope downwardly only up to the point to which they are slotted. Slidable rungs 16 are provided with guides 47*a* and *b* made of a suitable material such as Teflon and held by screws 48*a* and *b*. Each rung 16 is also provided with a pair of slots 51*a* and *c* in its upper surface near the front and back edges of the rungs to permit movement of spacer arms 23 and 24 which are rotatably mounted on spacer arm rods 50*a* and *b*. Each pair of upper spacer arms 23*a* and 23*c* are mounted inside the lower spacer arms 24*a* and 24*c*. Rivets 52*a* and 52*b* connect upper spacer arms 23*a* and 23*b* respectively with the lower spacer arms 24*a* and 24*c* of the identical rungs above. Similarly, rivets 53*a* and 53*b* connect lower pivot arms 24*a* and 24*c* to the upper spacer arms 23*a* and 23*c* of the identical rung below. In the collapsed position shown in FIG. 2 the spacer arms pivot inwardly toward the center of the rungs 16 so that the entire arrangement can be collapsed accordian fashion. Since uppermost slidable rung 16*a* must be accommodated in the slots 44*a* and 44*b* in the lower stile members 14*a* and 14*b* the entire weight of the lower stile section will assist in pulling slidable rung 16 into the spaced position.

Having set forth my invention and what is considered to be the best embodiment thereof, it will be understood that changes may be made from the specific embodiments set forth without departing from the spirit of the invention exceeding the scope thereof as defined in the following claims.

I claim:

1. A ladder unit for installation in a building comprising a ladder, a frame suitable for mounting in a window, and means for attaching said ladder to said frame; said ladder comprising a plurality of telescoping pairs of stile means including an upper pair of stile means having a rung attached adjacent to its upper end; a lower pair of stile means having a rung attached adjacent to its lower end; a plurality of slidable rungs slidably mounted in said stile means permitting positioning of said slidable rungs substantially adjacent to the attached rung on the upper stile means in the storage position; said slidable rungs having means to maintain the rungs in substantially equal and parallel spaced relation over the length of said ladder in extended position; in which said ladder is mounted in said frame in the storage position by arms pivotally attached to said frame and said ladder which allow movement of said ladder outwardly and downwardly to an extended position and means attached to said frame and said ladder for limiting outward and downward movement of said ladder to the extended position in which the ladder is spaced parallel from said frame by a distance sufficient to permit access by a person between said frame and said ladder; said ladder unit including means responsive to actuation from inside or outside of said frame for releasing said ladder from the storage position.

* * * * *